US006662528B2

(12) United States Patent
Holt et al.

(10) Patent No.: US 6,662,528 B2
(45) Date of Patent: Dec. 16, 2003

(54) MOBILE AUTOMATIC SANDBAGGER AND METHOD OF USE

(76) Inventors: Stephen I. Holt, 23000 Gilmore St., West Hills, CA (US) 91307; Ian B. Holt, 23000 Gilmore St., West Hills, CA (US) 91307

( * ) Notice: Subject to any disclaimer, the term of this patent is extended or adjusted under 35 U.S.C. 154(b) by 105 days.

(21) Appl. No.: 09/765,525

(22) Filed: Jan. 19, 2001

(65) Prior Publication Data

US 2001/0032442 A1 Oct. 25, 2001

Related U.S. Application Data

(60) Provisional application No. 60/177,465, filed on Jan. 21, 2000.

(51) Int. Cl.[7] ..... B65B 51/00

(52) U.S. Cl. ..... 53/417; 53/138.7; 53/570; 53/284.7; 141/10; 141/114; 141/314

(58) Field of Search ..... 53/417, 139.1, 53/138.1, 138.7, 469, 570–573, 284.7, 384.1; 141/10, 18, 114, 231, 313, 314, 315, 317

(56) References Cited

U.S. PATENT DOCUMENTS

| | | | | | |
|---|---|---|---|---|---|
| 3,552,346 | A | * | 1/1971 | Garden | 141/313 |
| 4,184,522 | A | * | 1/1980 | Waite | 141/231 |
| 4,819,701 | A | * | 4/1989 | Thornton | 141/231 |
| 5,215,127 | A | * | 6/1993 | Bergeron | 141/10 |
| 5,417,261 | A | * | 5/1995 | Kanzler et al. | 141/10 |
| 5,491,960 | A | * | 2/1996 | Taylor, Jr. | 53/391 |
| 5,771,665 | A | * | 6/1998 | Nelson et al. | 141/10 |
| 5,893,260 | A | * | 4/1999 | McKenna | 53/451 |
| 6,112,956 | A | * | 9/2000 | Malone | 141/231 |

FOREIGN PATENT DOCUMENTS

JP 10025725 * 1/1998

* cited by examiner

*Primary Examiner*—Rinaldi I. Rada
*Assistant Examiner*—Thanh Truong

(57) ABSTRACT

A mobile, automatic sandbagging machine includes a source of sandbags and a guide track positioned adjacent to the source of sandbags. A hook attached to a chain of the guide track selectively removes a sandbag from the source of sandbags and advances the sandbag along the guide track. An end of the sandbag is opened under a fill chute, and the sandbag is partially filled with fill material. A closing mechanism closes the open end of the sandbag and the sandbag is removed from the machine.

26 Claims, 6 Drawing Sheets

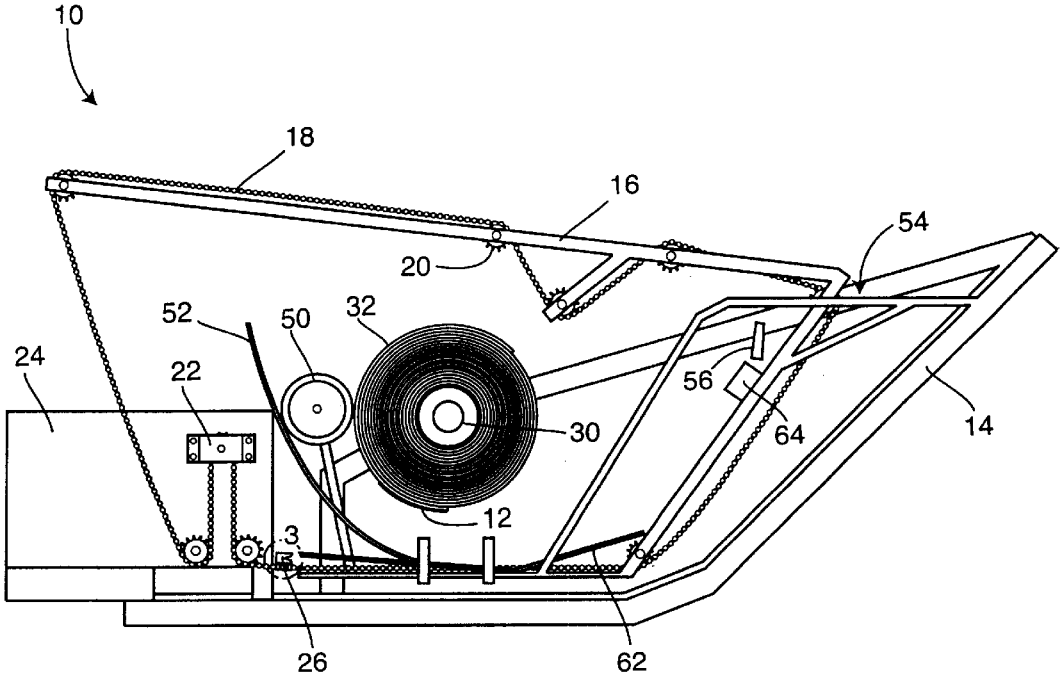
FIG . 1
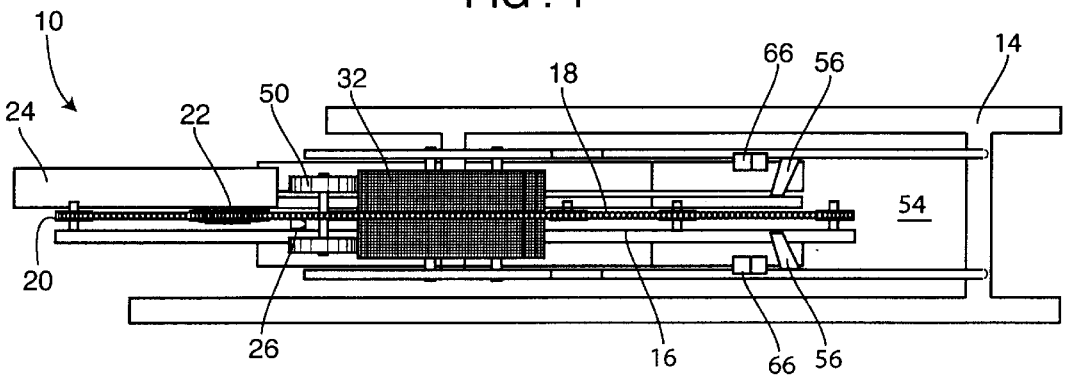
FIG . 2
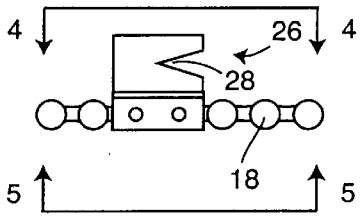
FIG . 3
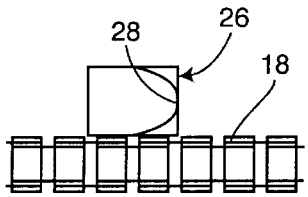
FIG . 4
FIG . 5
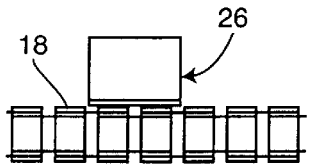

MOBILE AUTOMATIC SANDBAGGER AND METHOD OF USE

RELATED APPLICATION

This application claims priority from provisional application Ser. No. 60/177,465 filed Jan. 21, 2000.

BACKGROUND OF THE INVENTION

This invention relates to filling bags with fill material, such as sand. More particularly, the present invention relates to a mobile apparatus which automatically fills bags with sand or other fill material and closes the bags for use.

Heavy rains or coastal storms can lead to flooding damage. The damage caused by these storms can be greatly reduced by creating sandbag barrier walls to confine or re-direct the water to non-residential drainage areas. These walls must be built quickly and require a large number of sandbags.

Sandbags are typically filled with fill material, such as sand. The conventional practice is to have one person hold the bag open while another person uses a shovel to fill the bag. Once full, the bag must be tied to prevent the fill material from escaping the bag. This process can be dangerous to the person holding the bag. Sand can be thrown into the person's eyes. The blade of the shovel may also injuriously contact the person's hands. This process is also time consuming and requires a large number of people to fill the sandbags and create the barrier wall.

Sand hoppers have been created to aid in the process. These hoppers are usually loaded on a truck or a trailer and filled with sand or other fill material. The hopper agitates the sand and discharges the sand out of a chute. A bag is held under the chute by one person and then passed to another for tying when full. While creating sandbags more quickly than filling sandbags manually, this process also has the disadvantage of having several people involved in the process of filling and tying sandbags. The fill material must also typically be placed in the hopper or bed of the vehicle to be dispensed. The hoppers are also typically large and cumbersome and require vehicles to transport them from site to site.

Accordingly, there is a need for an automatic sandbagging apparatus which is self-contained and capable of producing filled and tied sandbags. Such an apparatus should be compact, mobile and easy to operate by only one or two people. The present invention fulfills these needs and provides other related advantages.

SUMMARY OF THE INVENTION

The present invention resides is a mobile sand bagging machine which automatically prepares sandbags. The machine includes a source of sandbags. In a particularly preferred embodiment, the source of sandbags comprises a plurality of sandbags rolled into a spool.

A guide track is positioned adjacent the source of sandbags. Means are provided for selectively removing a sandbag from the source of sandbags and advancing the sandbag along the guide track. Such means typically comprises a hook associated with the guide track and movable along the guide track and capable of removing the sandbag from the source of sandbags. The hook is typically attached to a chain associated with the motor for selectively advancing the chain along the guide track. The machine typically includes a timing mechanism for selectively advancing the hook and sandbag along the guide track.

In a particularly preferred embodiment, the sandbag includes a string removably attached to a lower surface thereof and which is engageable with the hook.

A fill chute is positioned relative to the guide track to enable the sandbag to be at least partially filled with external fill material. An expansion mechanism is associated with the chute and capable of opening an end of the sandbag for receipt of the fill material.

A sandbag closing mechanism is positioned adjacent to the chute for closing the open end of the sandbag. Typically, each sandbag includes a fastener attached thereto. The closing mechanism, in such instance, comprises a clamping mechanism configured to close the fastener about the open end of the sandbag.

In use, a sandbag is removed from the source of sandbags by engaging the hook to remove the sandbag. In a particularly preferred embodiment, the hook engages the string which is attached to the lower surface of the sandbag to remove the sandbag. The sandbag is then advanced along the guide track of the sandbagging machine. An end of the sandbag is opened using the expansion mechanism. Fill material is placed through the chute to at least partially fill the sandbag with fill material. The open end of the sandbag is then closed. In a particularly preferred embodiment, the closing step includes the step of clamping the fastener attached to the sandbag.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a cross-sectional side view of a sandbagging machine embodying the present invention;

FIG. 2 is a top plan view of the sandbagging machine of FIG. 1;

FIG. 3 is an enlarged elevational side view of area "3" of FIG. 1 illustrating a hook;

FIG. 4 is a top plan view taken along line 4—4 of FIG. 3;

FIG. 5 is a bottom plan view taken along line 5—5 of FIG. 3;

DETAILED DESCRIPTION OF THE PREFERRED EMBODIMENTS

Figure 6:
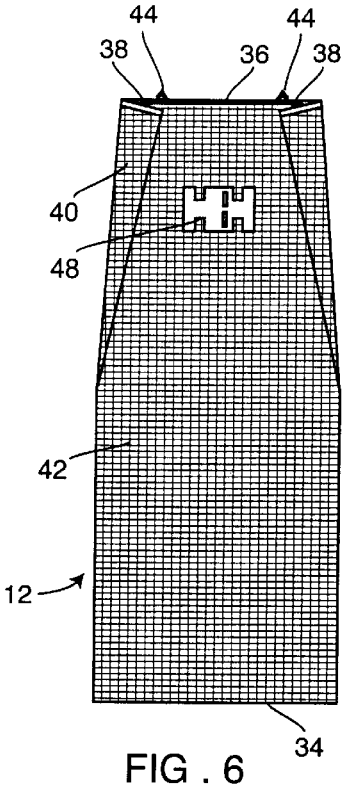
FIG. 6 is a top plan view of a sandbag used in accordance with the present invention, and having a fastener attached thereto.

As shown in the drawings for purposes of illustration, the present invention is concerned with a sandbagging machine, generally referred to by the reference number 10, which is self-contained and prepares sandbags automatically by filling, closing, and ejecting sandbags 12.

Referring to FIG. 1, the machine 10 includes structural framework 14 to hold the individual components of the invention in place. Such structural frame 14 is of a size that can be loaded into the bed of a truck, attached to a utility trailer, or form a trailer having axles and wheels which can be pulled behind a vehicle to enable the machine 10 to be mobile.

The sandbagging machine 10 includes a guide track 16 forming a generally circular path adjacent the periphery of the machine 10. The guide track 16 includes a chain 18 which continuously runs along the guide track 16 and periodically linked to gears 20 which maintain the chain 18 on its proper path. The chain 18 is linked to a timing mechanism 22 which is configured to advance and stop the chain at critical points along the guide track 16.

The sandbagging machine 10 includes a motor 24, such as an electric motor or combustible gasoline or diesel engine, which powers the sandbagging machine 10. More particularly, the motor 24 is connected to the timing mechanism 22 and chain 18 to operate the invention as will be further described.

At least one hook 26 is attached or otherwise associated with the chain 18. As illustrated in FIGS. 3–5, the hook 26 is a solid piece having a V-like notch. As illustrated, the hook 26 is attached to a side of the chain 18 so as not to interfere with the movement of the chain 18, but may be otherwise attached to the chain 18 so as not to interfere with its movement. The hook 26 is either attached to a predetermined chain link, or the timing mechanism 22 adjusted so that the hook 26 is at predetermined locations along the guide track 16 during the operation of the machine 10.

A free-rotating drum 30 is positioned within the machine 10 and configured to accept a spool 32 of sandbags 12. The spool 32 is comprised of a plurality of sandbags 12 that are placed on top of one another in a staggered and linear fashion and subsequently rolled into the spiral spool 32.

Figure 7:
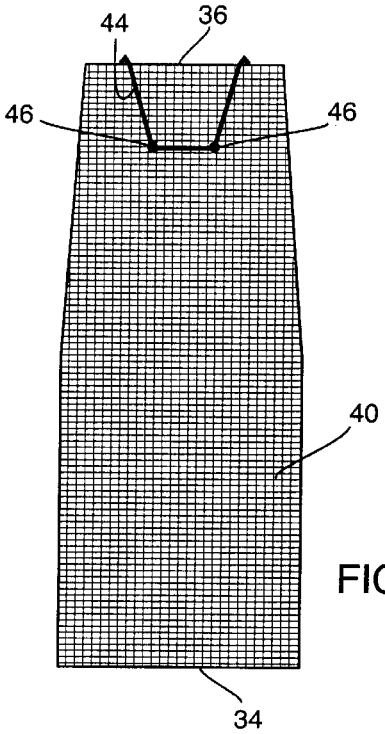
FIG. 7 is a bottom plan view of the sandbag of FIG. 6, illustrating string of the sandbag removably adhered to the bottom surface of the sandbag.

Referring now to FIGS. 6 and 7, in the preferred illustrated embodiment the sandbags 12 are modified somewhat to conform to the requirements of the sandbagging machine 10. Similar to traditional sandbags, the sandbags 12 of the present invention lie flat when empty, and typically have a dimension of approximately thirteen inches in width and twenty-four inches in length. Of course, sandbags of other dimensions may be utilized as well. The sandbag 12 is closed at one end 34 thereof in traditional fashion, for example by adhesion or threaded seam. The opposite end 36 is open similar to traditional sandbags. Stiffeners 38 are attached or otherwise installed along the uppermost edges of the open end 36 of the sandbag 12. These stiffeners 38 facilitate the opening of the sandbag 12 for filling as will be described more fully herein. The stiffeners 38 can be applied to the sandbag 12 with varying configurations in order to facilitate this opening. In a particularly preferred embodiment, the stiffeners 38 comprise two stiffeners 38 each extending from a top edge and corner of the bottom surface 40 and extending a predetermined distance towards the center of the sandbag 12. These stiffeners 38 are then folded over onto the top surface 42 of the sandbag 12. String 44 is attached to each corner of the open end 36 of the sandbag 12. The string is lightly adhered to the bottom surface 40 of the bag so as to be removable therefrom. Typically, resin droplets 46 are used to attach the string 44 lightly to the sandbag 12 and create a generally U-shaped configuration, although tape or other attachment means can be used.

Figure 8:
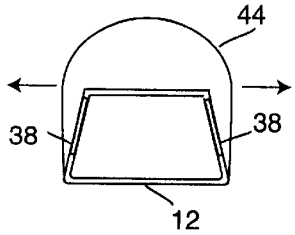
FIG. 8 an end view of the sandbag of FIGS. 6 and 7, illustrating the opening of an open end thereof.

As illustrated in FIG. 8, the stiffeners 38 facilitate the opening of the sandbag 12 when outward force is applied to the string 44 or open end 36 of the sandbag 12 itself. The string 44 is bound loosely by the resin 46, or other methods of adhesion, so that a segment, preferably approximately four inches in length, is not bound nor adhered to the sandbag 12.

A fastener 48 is attached or otherwise incorporated into an upper portion of the sandbag 12. Such fastener 48 is used to close off the bag open end 36 of the sandbag 12 when appropriately filled. In a particularly preferred embodiment, the fastener 48 is attached to the top surface 42 of the sandbag 12 and generally centered at a top portion thereof. The fastener 48 is preferably comprised of a piece of pliable sheet metal or other material having similar properties so as to be readily bendable.

Referring back to FIG. 1, the sandbags 12 are rolled such that the bottom surface 40 of the sandbag 12 having the string 44 attached thereto faces outward. Located at an outer edge of the drum 30 or spool 32 is a roller device 50. The roller 50 is linked to the timing mechanism 22, via a shaft or gears or the like, so that it is actuated and turns during predetermined intervals of the operation of the machine 10. The roller 50 is held in physical contact with the outer surface of the spool 32 by a spring or the like, such as the illustrated leaf spring 52. The surface of the roller 50 is frictionally tractive, and when actuated results in turning the spool 32 and drum 30 so that a sandbag 12 is at least partially removed therefrom.

Figure 9:
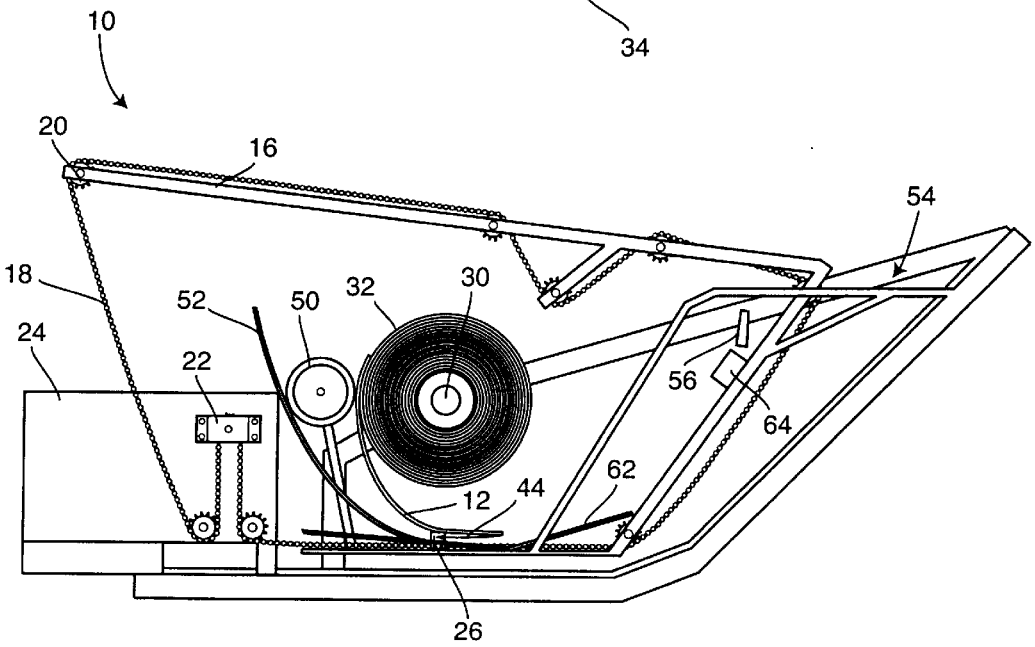
FIG. 9 is a cross-sectional side view of the sandbagging machine in accordance with the present invention, illustrating the removal of a sandbag from a spool of sandbags.

Referring now to FIG. 9, a sandbagging machine 10 having a sandbag 12 partially removed from the spool 32 so as to overlie the guide track 16 is illustrated. Simultaneously, the chain 18 is advanced so that hook 26 progresses under the sandbag 12 and engages the unattached segment of string 44 in its notch 28. The sandbag 12 is then pulled and separated from the spool 32 as the hook 26 advances.

Figure 10:
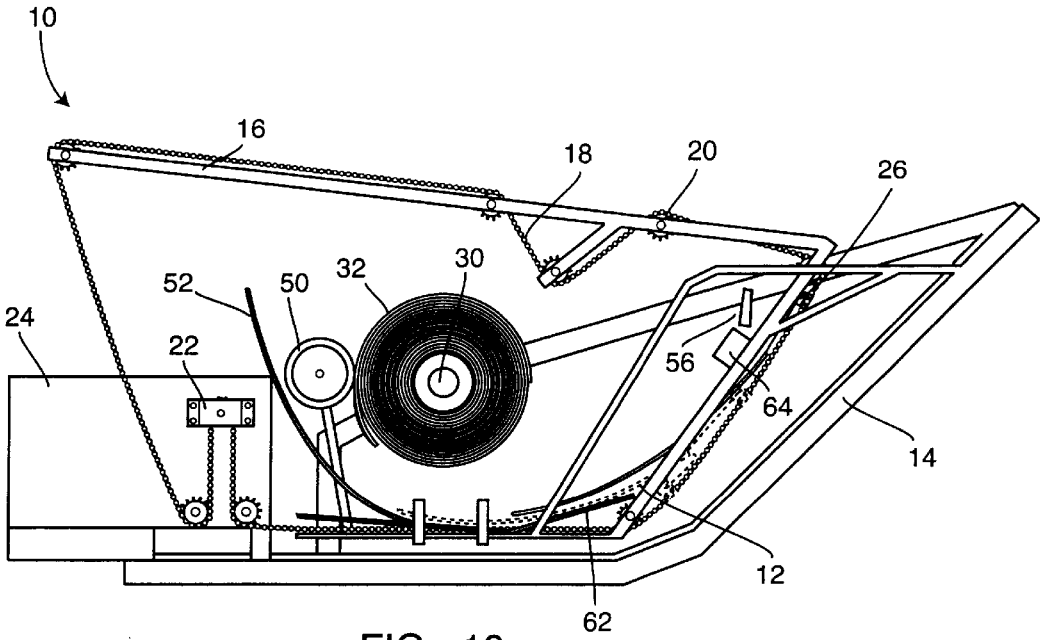
FIG. 10 is a cross-sectional side view of the automatic sandbagging machine of the present invention, illustrating the advancement of the removed sandbag to an expansion and chute portion of the machine.
Figure 11:
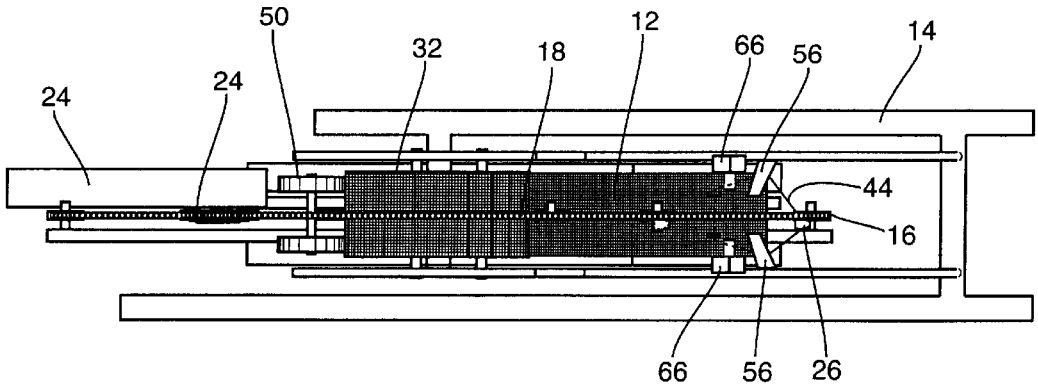
FIG. 11 is a top plan view of FIG. 8.

With reference to FIGS. 10 and 11, the string 44 breaks its attachment with the bottom surface 40 of the sandbag 12 as the sandbag 12 is pulled by hook 26 along the guide track 16. The sandbag 12 travels along the guide track 16 until it is positioned under a chute 54 or open area configured to receive a chute or outlet of a hopper, etc.

The string 44 is pulled away from its adhesion with the bottom surface 40 of the sandbag 12 as the hook 26 pulls it, and the sandbag 12, along the guide track 16.

Figure 12:
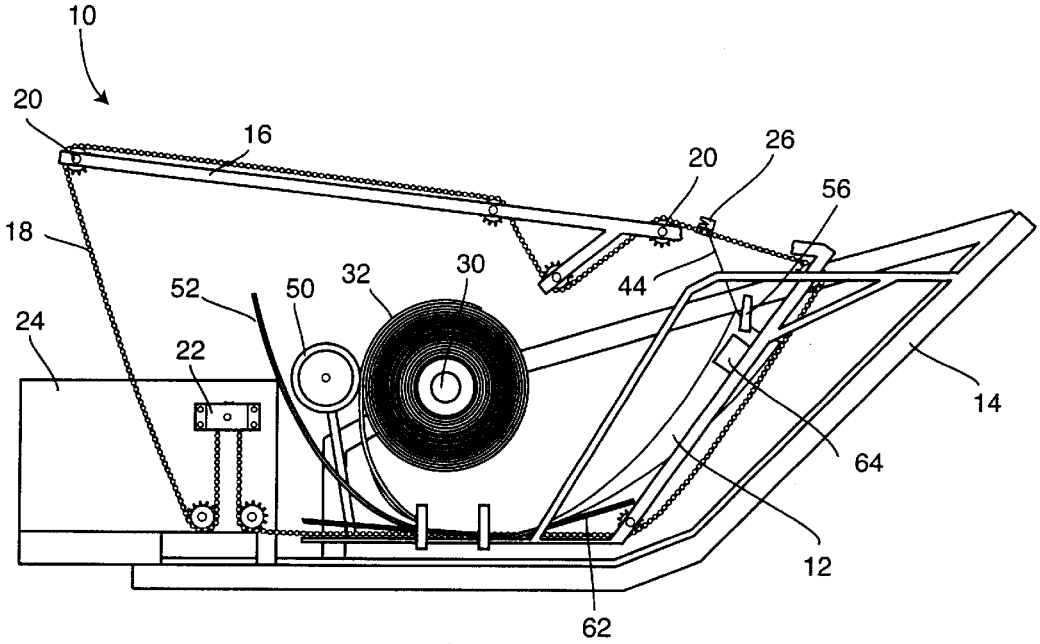
FIG. 12 is a cross-sectional side view of the sandbagging machine, illustrating the opening of an end of the removed sandbag.
Figure 13:
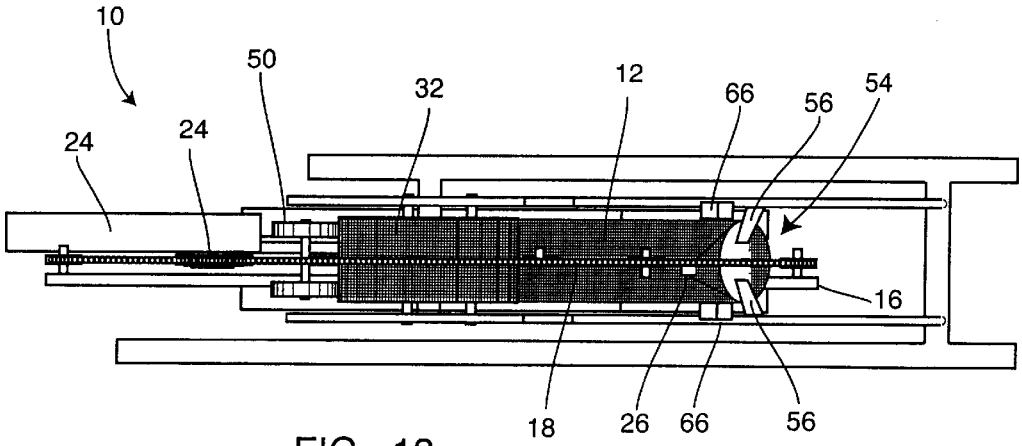
FIG. 13 is a top plan view of FIG. 10.

Referred now to FIGS. 12 and 13, the hook 26 and chain 18 continue to bring the open sandbag 12 along the guide track 16 until it eventually encounters and surrounds the chute 54.

Upon approaching the chute 54, the open end 36 of the sandbag 12 is forced open under the chute 54 so that the sandbag 12 can be filed with sand or other fill material. The opening mechanism employed by the sandbagging machine can vary, but typically is provided by one of two methods. In a first method, the hook 26 proceeds along the guide track 16 so as to position the string 44 taut relative to the sandbag 12 to force the stiffeners 38 to become repositioned from a generally flat and horizontal position, to a angled or near vertical position facing one another, creating an opening in the sandbag 12 as illustrated in FIG. 8. Alternatively, the guide track 16 includes finger-like projections 56 which enter the open end 36 of the sandbag 12 and force the sandbag to increasingly open as the sandbag is brought up towards the chute 54. The projections 56 are typically flared so as to have a relatively small width at the receiving end thereof, and a larger width towards the end thereof so as to open the sandbag 12. Such projections 56 can also be used to force the string 44 to expand, resulting in the adjustment of the stiffeners 38 to open the sandbag 12. Other opening mechanisms and methods may also be employed.

The timing mechanism 22 then temporarily stops the hook 26 and chain 18 movement. Sand 58 or other fill material is then added into the sandbag 12 through its open end 36. This may be accomplished by shoveling sand and fill material into the chute until the sandbag 12 is appropriately filled, placing the chute 54 underneath a hopper 60 or the like which can administer sand 58 and fill material, or the sandbagging machine 10 may include a conveyer system (not illustrated) which automatically feeds the chute 54 with sand fill material 58. Such a conveyer system can have intake ports where sand and fill material 58 is added, a belt having paddle-like ridges to move the fill material 58 into the chute 54. Such a conveyer system could be linked to the motor 24 and timing mechanism 22. A filter screen can be positioned above the chute 54, or when using the conveyer system at the inlet of the conveyer, so that large rocks, twigs and other potentially damaging debris is prevented from entering the sandbagging machine 10.

Figure 14:
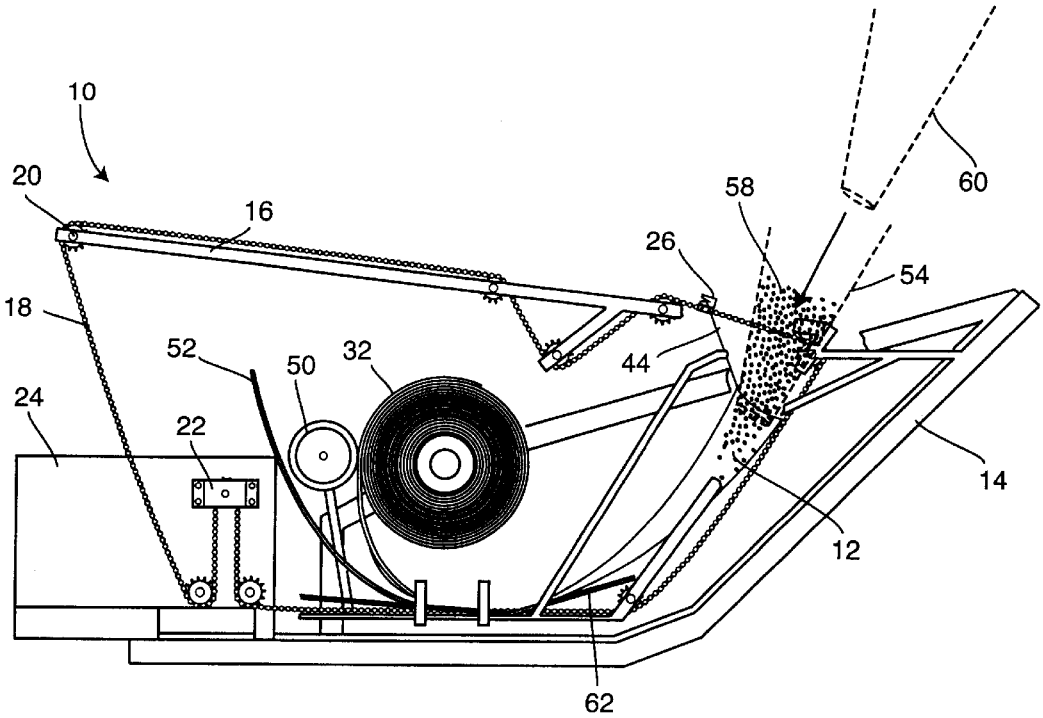
FIG. 14 is a cross-sectional side view of the sandbagging machine, illustrating fill material being added through a chute and into the opened sand bag.
Figure 15:
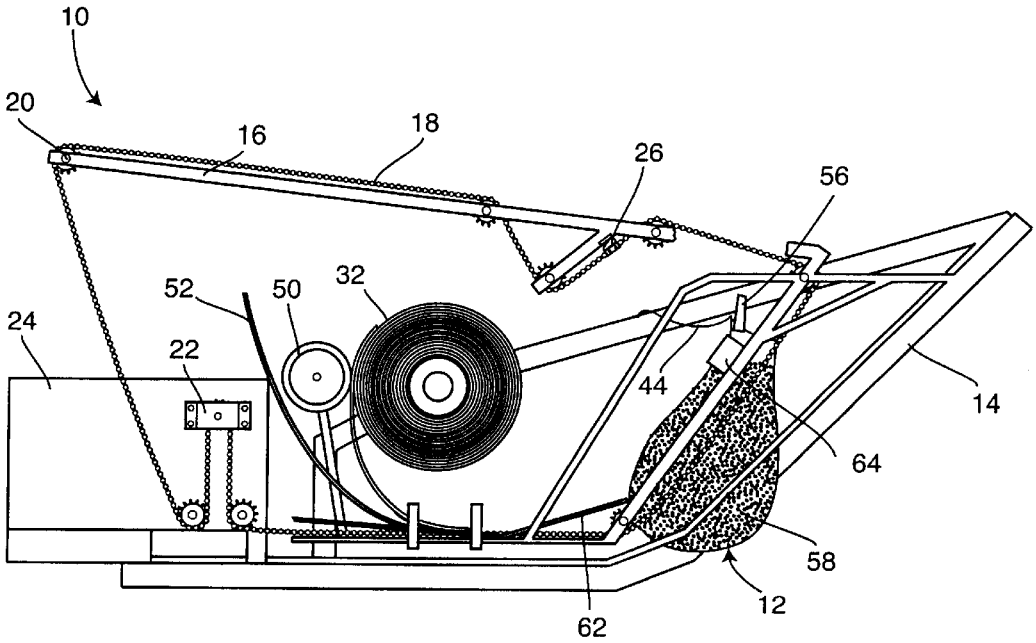
FIG. 15 is a cross-sectional side view of the sandbagging machine, illustrating the sandbag partially filled with fill material.

Referring now to FIGS. 14 and 15, sand or fill material 58 is added into the sandbag 12 until the sandbag is appropriately filled, typically approximately three-quarters full. Determining when the sandbag 12 is appropriately filled can be accomplished by various methods. An operator of the sandbagging machine 10 may visually determine that the sandbag 12 is appropriately full, and depress a button or the like to continue the remaining operation. Alternatively, in a particularly preferred embodiment, the sandbag 12 is positioned under the chute 54 so that as it fills with sand and fill material 58, it enlarges and pushes against a sensor 62. Preferably, the sensor 62 comprises a curved paddle or lever which can pivot. Once the sensor lever 62 pivots to a predetermined position, the timing mechanism 22 is actuated. A closing mechanism is then actuated to close off the open end 36 of the sandbag 12. The closing mechanism can comprise a mechanism which sews, wire-twists, or adhesively closes the open end 36 of the bag 12.

Figure 16:
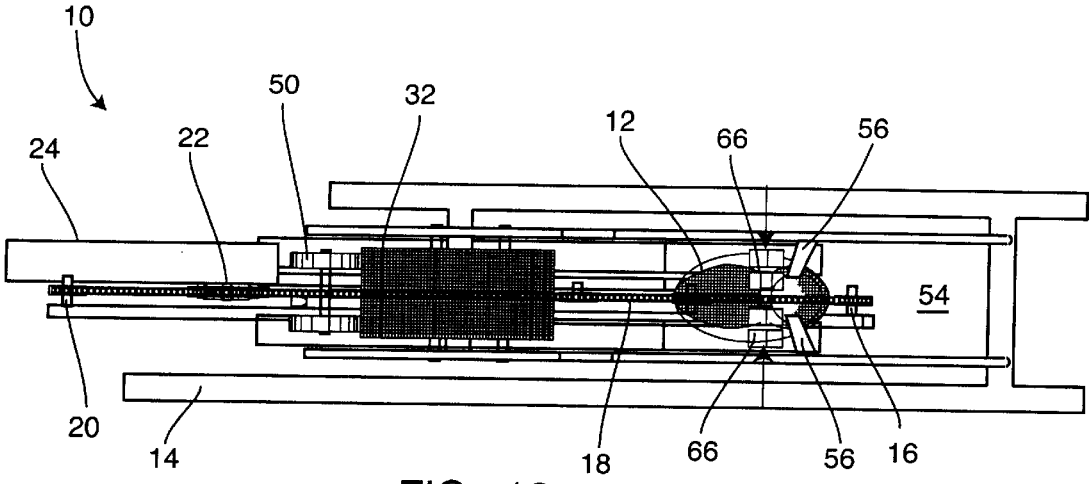
FIG. 16 is a top plan view of FIG. 15, illustrating the clamping mechanism being actuated to close off the partially filled sandbag.

Referring now to FIG. 16, in a particularly preferred form of the invention, the closing mechanism comprises a clamping mechanism 64 having opposed clamps 66 which are configured to surround the open end 36 of the sandbag 12 and retract towards one another so as to engage the fastener 48 and cause the fastener 48 to bend upon itself and close the sandbag 12.

Figure 17:
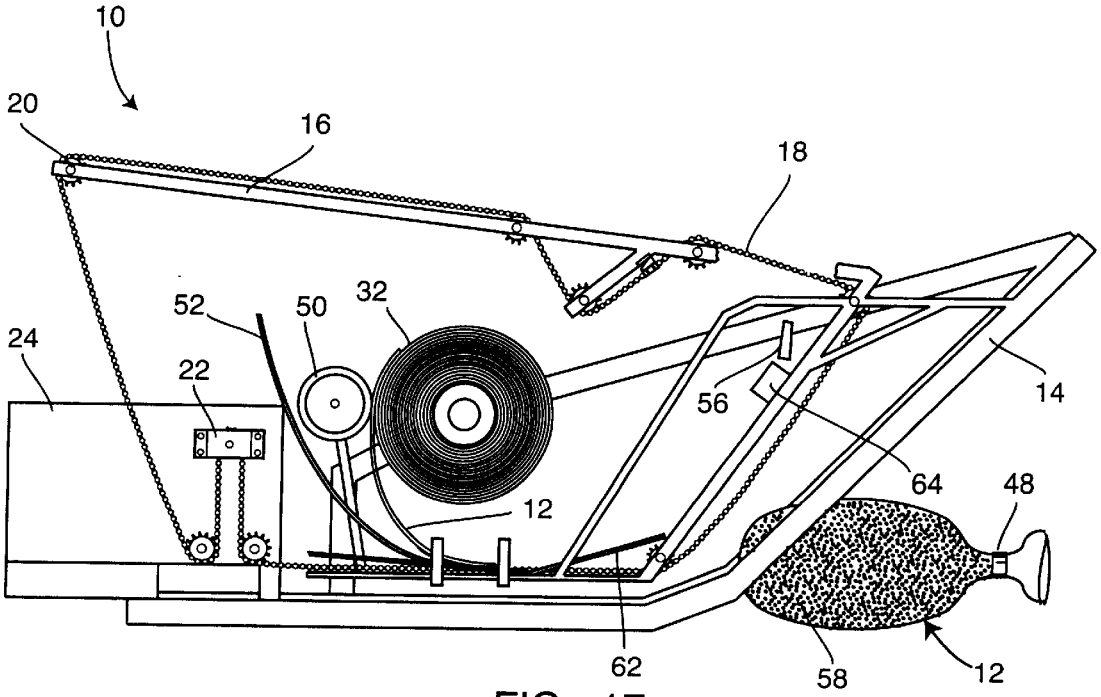
FIG. 17 is a cross-sectional side view of the sandbagging machine, illustrating the partially filled sandbag having its open end closed and removed from the guide track of the machine.

After the sandbag 12 has been filled and closed, the sandbag 12 is ejected from the sandbagging machine 10, as illustrated in FIG. 17. Although the sandbag 12 can be ejected in several manners, typically, the hook 26 is advanced along the guide track 16 until the string 44 is cut, for example by a sharpened surface position along the guide track 16, or breaks, or becomes disengaged with the sandbag 12. The sandbag 12 is then allowed to fall through an aperture, which may include a downwardly directed ramp (not shown).

The hook 26 and chain 18 are advanced, and the roller 50 actuated to begin the process again. Although only one hook 26 is illustrated as being attached to the chain 18, it is to be understood that two or more hooks 26 may be positioned along the length of the chain 18 so that a sand bag 12 is removed from the spool 32 and advanced along the guide track 16 immediately after the previously removed sandbag 12 is filled, closed and ejected.

The benefits of using the sandbagging machine 10 of the present invention are many and include providing a sandbagging machine 10 which is both compact and mobile. The sandbagging machine 10 can be operated by as few as a single person. The sandbagging machine 10 also allows sandbags 12 to be prepared at a much faster rate than other methods as the sandbag can be advanced, filled, and closed in a short period of time, without the risk of injury present in other existing methods.

Although several embodiments have been described in detail for purposes of illustration, various modifications may be made without departing from the scope and spirit of the invention. Accordingly, the invention is not to be limited, except as by the appended claims.

What is claimed is:

1. A mobile, automatic sandbagging machine, comprising:

a source of sandbags, wherein each sandbag includes a fastener attached adjacent to an open end thereof;

a guide track adjacent the source of sandbags;

means for selectively removing a sandbag from the source of sandbags and advancing the sandbag along the guide track;

a fill chute positioned relative to the guide track to enable the at least partial filling the sandbag with external fill material; and a sandbag closing mechanism adjacent to the chute, and comprising a clamping mechanism configured to close the fastener about the open end of the sandbag.

2. The sandbagging machine of claim 1, including an expansion mechanism associated with the chute and capable of opening an end of the sandbag for receipt of fill material.

3. The sandbagging machine of claim 1, wherein the source of sandbags comprises a plurality of sandbags rolled into a spool.

4. The sandbagging machine of claim 1, wherein the means for removing comprises a hook associated with the guide track and movable along the guide track and capable of removing the sandbag from the source of sandbags.

5. The sandbagging machine of claim 4, wherein the sandbag includes a string attached to a lower surface thereof and engageable with the hook.

6. The sandbagging machine of claim 4, wherein the hook is attached to a chain associated with a motor for selectively advancing the chain along the guide track.

7. The sandbagging machine of claim 1, including a timing mechanism for selectively advancing the sandbag along the guide track.

8. A mobile, automatic sandbagging machine, comprising:

a source of sandbags;

a guide track extending below the source of sandbags, the guide track including a chain operably connected to a motor;

means for selectively removing a sandbag from the source of sandbags and advancing the sandbag along the guide track, including a hook attached to the chain and capable of removing a sandbag from the source of sandbags;

a timing mechanism operably connected to the motor for selectively advancing the hook along the guide track;

an expansion mechanism associated with the guide track and capable of opening an end of the sandbag for receipt of fill material;

a fill chute adjacent the expansion mechanism and capable of at least partially filling the sandbag with external fill material; and a sandbag closing mechanism adjacent the chute.

9. The sandbagging machine of claim 8, wherein the source of sandbags comprises a plurality of sandbags offset from one another and rolled into a spool.

10. The sandbagging machine of claim 8, wherein each sandbag includes a string attached to a lower surface thereof and engageable with the hook.

11. The sandbagging machine of claim 8, wherein each sandbag includes a fastener attached thereto.

12. The sandbagging machine of claim 11, wherein the closing mechanism comprises a clamping mechanism configured to close the fastener about the open end of the sandbag.

13. A mobile, automatic sandbagging machine, comprising:

a source of sandbags comprising a plurality of individual sandbags having an open end and a closed end, the plurality of sandbags being rolled into a spool;

a guide track adjacent the source of sandbags;

means for selectively removing a sandbag from the source of sandbags and advancing the sandbag along the guide track; and a fill chute positioned relative to the guide track to enable the at least partially filling the sandbag with external fill material.

14. The sandbagging machine of claim 13, including an expansion mechanism associated with the chute and capable of opening an end of the sandbag for receipt of fill material.

15. The sandbagging machine of claim 13, wherein the means for removing comprises a hook associated with the guide track and movable along the guide track and capable of removing the sandbag from the source of sandbags.

16. The sandbagging machine of claim 15, wherein the sandbag includes a string attached to a lower surface thereof and engageable with the hook.

17. The sandbagging machine of claim 13, including a sandbag closing mechanism adjacent to the chute.

18. The sandbagging machine of claim 17, wherein each sandbag includes a fastener attached adjacent to the open end thereof; and wherein the closing mechanism comprises a clamping mechanism configured to close the fastener about the open end of the sandbag.

19. The sandbagging machine of claim 13, including a timing mechanism for selectively advancing the sandbag along the guide track.

20. A mobile, automatic sandbagging machine, comprising:

a source of sandbags;

a guide track adjacent the source of sandbags;

a hook associated with the guide track and movable along the guide track and capable of removing the sandbag from the source of sandbags and advancing the sandbag along the track; and a fill chute positioned relative to the guide track to enable the at least partially filing the sandbag with external fill material.

21. The sandbagging machine of claim 20, including an expansion mechanism associated with the chute and capable of opening an end of the sandbag for receipt of fill material.

22. The sandbagging machine of claim 20, wherein the source of sandbags comprises a plurality of sandbags rolled into a spool.

23. The sandbagging machine of claim 20, wherein the sandbag includes a string attached to a lower surface thereof and engageable with the hook.

24. The sandbagging machine of claim 20, including a sandbag closing mechanism adjacent to the chute.

25. The sandbagging machine of claim 24, wherein each sandbag includes a fastener attached thereto, and wherein the closing mechanism comprises a clamping mechanism configured to close the fastener about the open end of the sandbag.

26. The sandbagging machine of claim 20, including a timing mechanism for selectively advancing the sandbag along the guide track.

* * * * *